United States Patent [19]

Omley

[11] 4,153,959

[45] May 15, 1979

[54] SPRING ATTACHMENT CLIP

[75] Inventor: Herbert A. Omley, Wickenburg, Ariz.

[73] Assignee: Omley Industries, Inc., Wickenburg, Ariz.

[21] Appl. No.: 867,715

[22] Filed: Jan. 9, 1978

Related U.S. Application Data

[63] Continuation of Ser. No. 705,135, Jul. 14, 1976, abandoned.

[51] Int. Cl.[2] ..... A47C 23/02; A47B 21/00

[52] U.S. Cl. ..... 5/259 R; 24/84 R; 267/102

[58] Field of Search ..... 5/259 B, 259 R; 206/345, 347, 343; 403/208; 267/102; 24/84 R, 84 B, 85 R, 85 B, 86 R, 86 B

[56] References Cited

U.S. PATENT DOCUMENTS

| | | | |
|---|---|---|---|
| 2,249,031 | 7/1941 | Neely | 5/259 B |
| 3,450,255 | 6/1969 | Mosetich | 206/56 |
| 3,551,282 | 12/1970 | Hogue | 5/259 R |
| 3,720,960 | 3/1973 | Bond | 5/259 R |
| 4,062,087 | 12/1977 | Lingle | 24/84 R |

*Primary Examiner*—Casmir A. Nunberg
*Attorney, Agent, or Firm*—Warren F. B. Lindsley

[57] ABSTRACT

A spring attachment clip for the fastening of springs to furniture frames, the clip carrying its own means for being secured to the frame and having in addition means for reducing or eliminating audible noise as ordinarily caused by the action of the spring working against the clip. The clip configuration is adapted to permit its multiple formation in long strips intended to be fed into an automatic device which separates the individual clips from the strips and secures them to the frame. Additionally, the U-shaped edges of the spring engaging end of the clips are bevelled outward to strengthen the clip rendering it unnecessary to close the clip to prevent its opening under spring tension.

21 Claims, 17 Drawing Figures

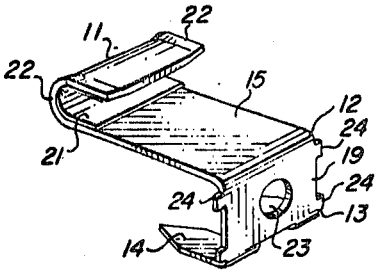
FIG. 1
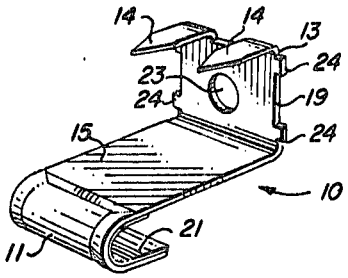
FIG. 2
FIG. 3
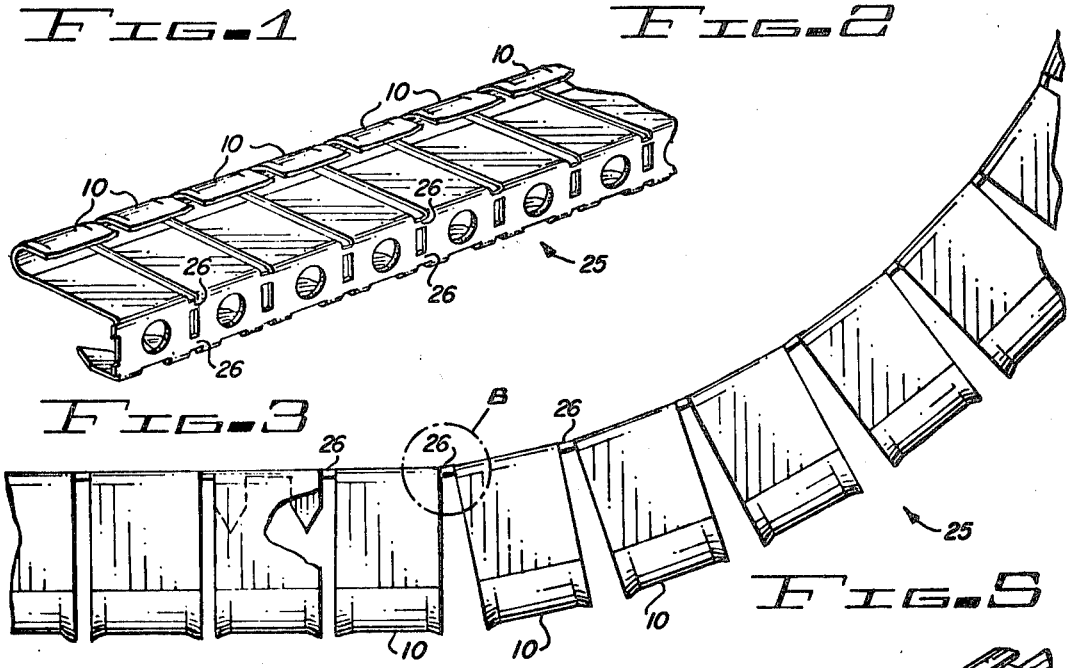
FIG. 5
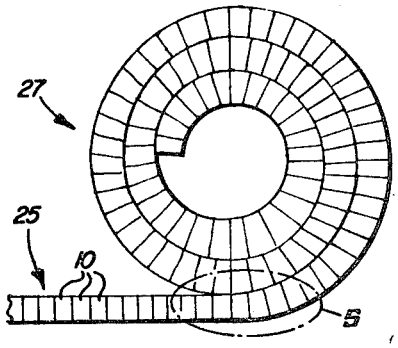
FIG. 4
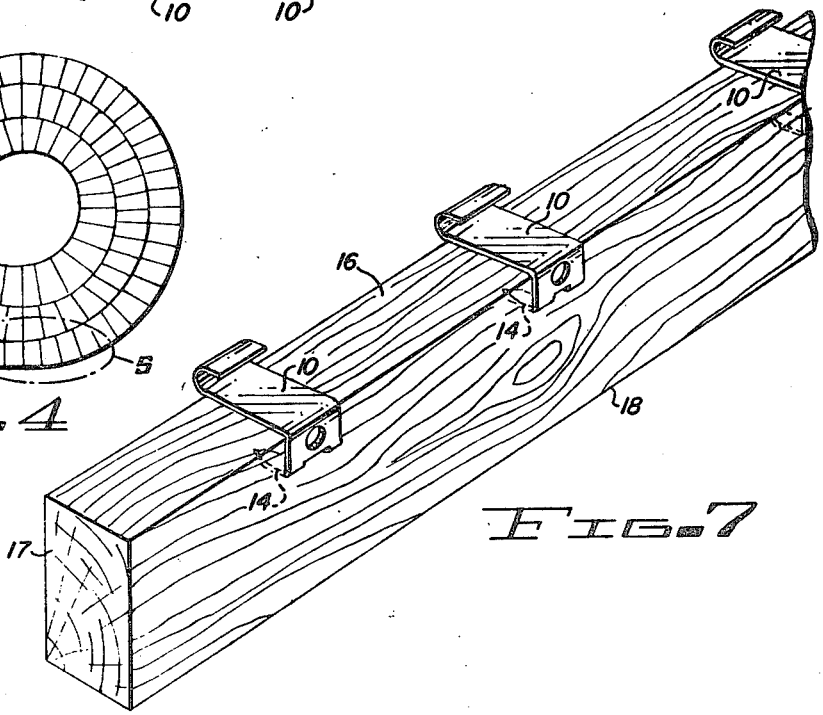
FIG. 7

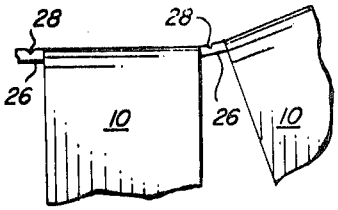
FIG. 6
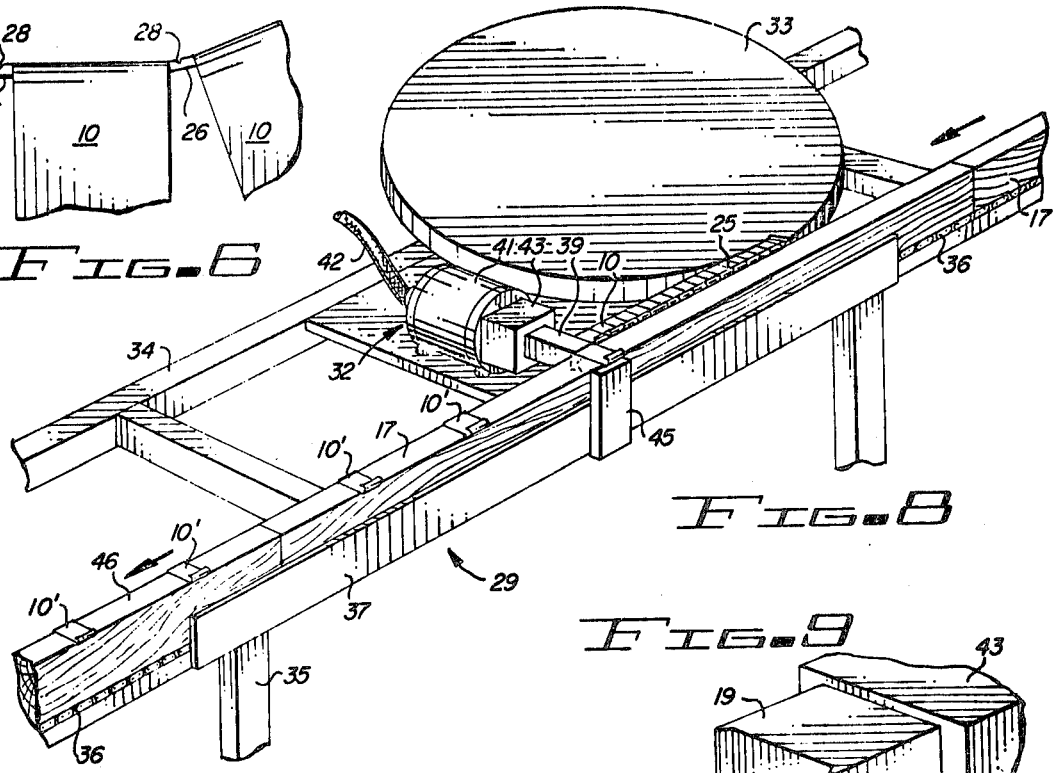
FIG. 8
FIG. 9
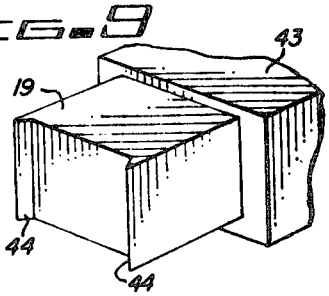
FIG. 11
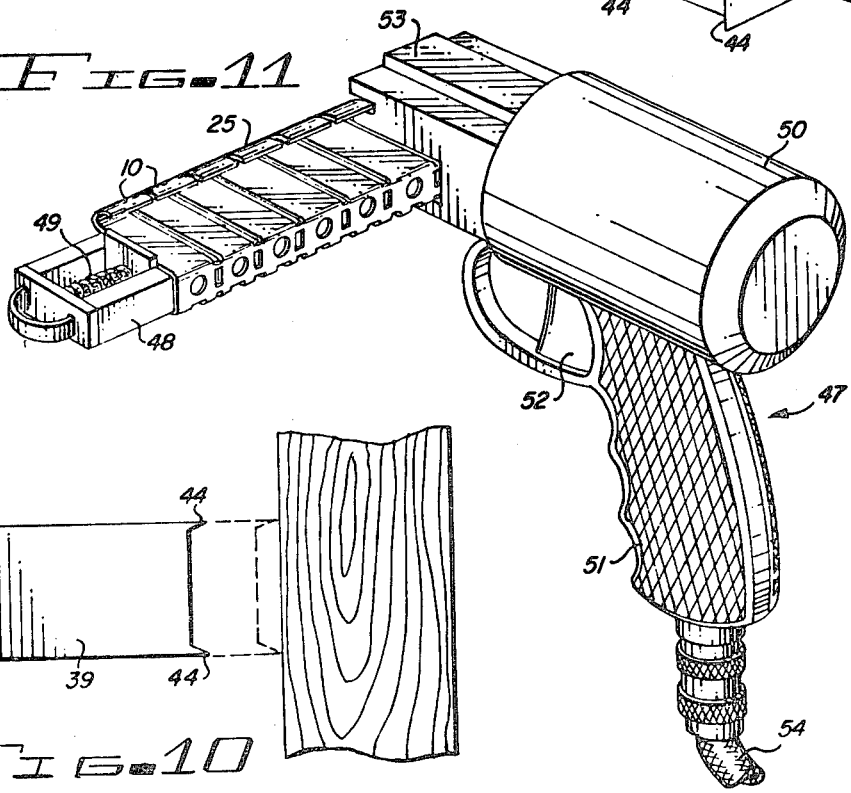
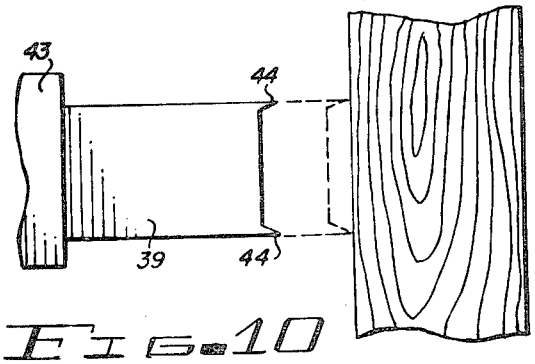
FIG. 10

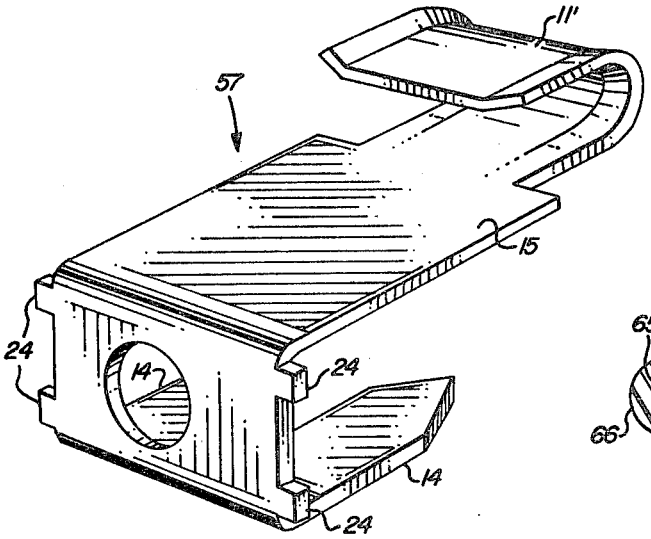
FIG. 12
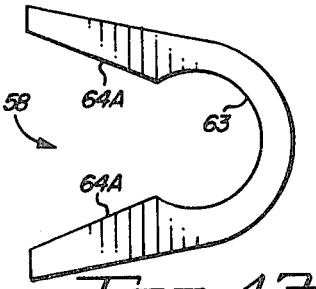
FIG. 13
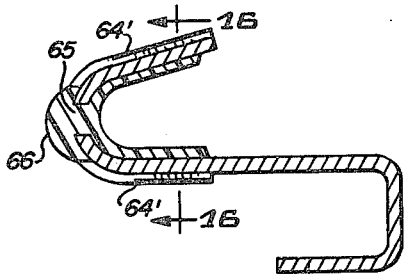
FIG. 15
FIG. 14
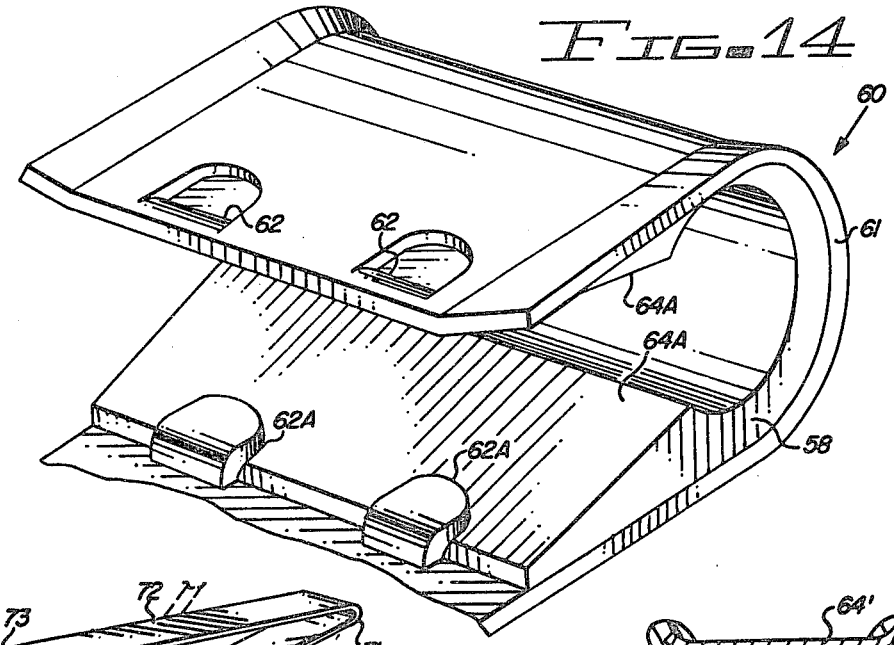
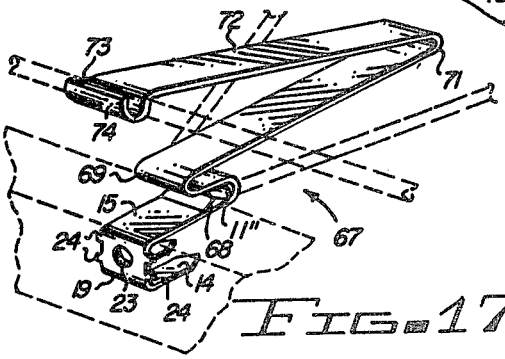
FIG. 17
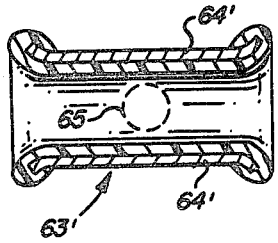
FIG. 16

SPRING ATTACHMENT CLIP

This application is a continuation of Ser. No. 705,135 filed 07/14/1976 now abandoned.

BACKGROUND OF THE INVENTION

In the field of furniture construction, there is a continuing need for devices with which springs may be attached to the wooden framework of chairs, couches and other pieces of furniture. In the past, various clip-like devices have been used, generally comprising a bent portion with which to engage the spring and the remaining portion with which to provide a base for attaching the clip to the framework. In most cases, the base was perforated with one or more holes through which securing means such as nails, screws or staples were passed for fastening to the frame.

More recently, improved clip designs have been provided which eliminate the need for the additional hardware, i.e. the nails, screws or staples by incorporating in the body of the clip its own means for being secured to the frame. Such a clip is described in U.S. Pat. No. 3,720,960 by J. J. Bond. Bond's clip utilizes a pair of sharp prongs formed at the end opposite the spring attachment end, the prongs being adapted to be driven into the wooden frame.

By eliminating the need for the additional hardware, the clip provided by Bond is an improvement over the prior art materially reducing the difficulty and the time required for attaching the clip to the frame.

While the clip provided by Bond comprised a substantial improvement over the prior art since it can not be pulled out of the furniture frame while in use and carries its own means for being secured to the frame also incorporating an integral means for noise reduction it does not lend itself to multiple formation in strips from which individual clips may be separated and secured by automatic means.

SUMMARY OF THE INVENTION

In accordance with the invention claimed, an improved clip is provided for the attachment of springs to the framework of furniture, the clip comprising a one-piece device specially configured to facilitate the automatic attachment of the clips to furniture frames. The clip requires no auxilliary hardware such as nails, screws or staples for attachment to the frame and means are integrally incorporated to reduce or eliminate audible noise due to the relative motion of the springs relative to the clips which may be selectively applied to strategic areas only for cost reduction purposes.

It is, therefore, one object of the present invention to provide an improved clip for the attachment of springs to the framework of furniture.

Another object of this invention is to provide such a clip which requires no auxiliary hardware for the attachment to the furniture frame.

A further object of this invention is to provide such a clip in a one-piece configuration while incorporating means for substantially reducing or eliminating audible noise as ordinarily produced by the working of the spring against the clip and in strategic areas only for cost reduction purposes.

A still further object of this invention is to provide such a clip in a configuration which is amenable to fabrication in large quantities at low cost in a punch press operation.

A still further object of this invention is to provide such a clip configuration which lends itself to the production of large numbers of such clips joined together in continuous strips which may be readily separated and secured to the furniture frame by automatic equipment.

A still further object of this invention is to provide such a clip in a form which will remain firmly anchored to the frame and which will sustain a firm grip on the attached spring throughout the normal life of the furniture in which it is installed.

A still further object of this invention is to provide such a clip which incorporates a sound deadening means which has improved durability relative to similar means provided in the past.

Yet another object of this invention is to provide the spring engaging end of the clip with ridges along its edges to reinforce these edges to remain firm under spring tension thereby avoiding the necessity of stapling them closed.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of a spring clip of this invention;

FIG. 2 is a perspective view of the clip of the invention as viewed from a different angle;

FIG. 3 is a perspective view of a number of the clips of the invention joined by interconnecting fragile webs into a continuous strip of clips;

FIG. 4 is a simplified representation of such a strip of clips formed into a coil or roll from which it may be unwound as it is fed into an automatic machine for attachment to a furniture frame member;

FIG. 5 is an enlarged view of segment 5 of FIG. 4 showing a more detailed plan view of a section of the coiled strip of clips;

FIG. 6 is an enlargement of segment 6 of FIG. 5 showing details of the web joining adjacent clips in the strip of FIGS. 3–5;

FIG. 7 is a perspective view showing the clips of the invention secured to a furniture frame member;

FIG. 8 is a perspective view of an automatic machine and associated fixtures arranged for the automatic securing of the clips to furniture frame members, the clips being dispensed from a coil of clips as defined by FIGS. 3–6;

FIG. 9 is a perspective view of a working member of the automatic machine included in the arrangement of FIG. 8;

FIG. 10 is a plan view of the working member of FIG. 9 shown in operation with motion indicated relative to a stationary furniture frame member;

FIG. 11 is an enlarged perspective view of an automatic hand held device for securing the clips of the invention to a furniture frame member, the device dispensing clips from a continuous strip of clips as shown in FIG. 3.

FIG. 12 is a perspective view of a modification of the spring clip shown in FIGS. 1–6;

FIG. 13 is a cross-sectional view of a modification of the non-metallic liner shown in FIGS. 1 and 2';

FIG. 14 is a partial perspective view of a modification of the spring clips shown in FIGS. 1, 2 and 12 with the liner shown in FIG. 13 held in place by punch-out fingers of the spring clip;

FIG. 15 is a cross-sectional view of a clip showing a modified way of anchoring the clip insert to the clip U-shaped spring engaging end;

FIG. 16 is a cross-sectional view of FIG. 15 taken along the lines 16—16; and

FIG. 17 is a perspective view of a further modification of the spring clips of this invention formed to provide an additional resiliency when used in the supporting frame of cushion held furniture.

DESCRIPTION OF THE PREFERRED EMBODIMENT

Referring more particularly to the drawing by characters of reference, FIGS. 1 and 2 disclose a spring clip 10 of this invention which is formed from a piece of sheet metal such as steel having one end 11 bent over on itself into a U-shaped configuration. The U-shaped end 11 is designed with a radius such that it will receive a spring of the type commonly employed as a resilient support in furniture such as chairs, sofas or the like, the spring usually having a circular cross-sectional configuration. The remaining portion of the sheet metal is bent 90 degrees at two points 12 and 13 so that it too forms a U-shaped portion having square corners whereby the overall configuration of clip 10 may be thought of as representing in profile an S-shaped device. An outer table having one or more legs 14 of the square-shaped U may be pointed or notched as shown. In operation base 15, defined as that portion of clip 10 comprising the common leg to both U-shaped portions and also defined as that portion generally aligned with the force exerted by the spring it is intended to secure, is also aligned with a top horizontal surface 16 of a furniture frame member 17 to which it is attached. Side 18 of member 17 is oriented to the outside of the furniture frame. The outside leg 14 is driven by an impact tool into frame member 17 until base 19 of the square U-shaped configuration of the clip is in contacting relationship with side 18 of member 17 to act as a flange with respect to base portion 15. Clip 10 is thus firmly attached to frame member 17 by its two contacting sides 15 and 19 and by the third embedded side 14. The disclosed clip is so designed that it cannot be pulled out of the frame.

In terms of the features described thus far, clip 10 is similar to the Bond clip of U.S. Pat. No. 3,720,960. The incorporation of certain relatively subtle modifications yet to be described, however, provides important enhancements which constitute the subject matter of the present invention.

The U-shaped end 11 of clip 10 is modified in two ways to reduce audible noise produced by the working action between clip 10 and an attached spring. A nonmetallic liner 21 covers the inside surface of U-shaped end 11 with liner 21 serving as a resilient interface between clip 10 and the attached spring. In addition, to prevent the abrasive action of the attached spring from cutting through liner 21 at the edges of clip 10, the edges 22 are bevelled outwardly the entire length of the U-shaped configuration to form a ribbed surface. The rib on the ridge reinforces the clip edges to prevent spring pressure from opening up the U-shaped configuration. This is in contrast to prior art practice which only provided a bevel along the base of the U and permitted wear and eventual noise as the spring later rubbed directly against the metal at the sides of the U-shaped configuration.

Two other features of the configuration of clip 10 are non-functional in its end use, but they are involved in another important feature of the invention having to do with its fabrication and its automatic installation into a wooden frame member.

The first additional feature is a hole 23 in the center of side 19 which serves as a locator or registration hole for the fabrication of clip 10 in an automatic punch press. The hole 23 also may have utility in the proper positioning of clip 10 in an automatic installation device to be described later.

The second and more significant feature involves four tabs 24, two of which are located on each of the outer edges of side 19. The tabs 24 are vestiges of the original fabricated form of clip 10. As illustrated most clearly in FIG. 3, clips 10 are mass-produced in a continuous strip 25. To those skilled in the art of punch press operation, it will be apparent that strip 25 may be readily produced by an automatic punch press. The individual clips 10 in strip 25 are held together by narrow webs 26. When the clips are later separated by an automatic device which also secures the clips in a wooden frame, the remnants of web 26 at each clip become tabs 24 of FIGS. 1 and 2.

The flexibility of strip 25 at web 26 permits the strip to be coiled into a roll 27 as shown in FIG. 4. For clarification of the axis about which the flexing occurs, an enlargement of section 5 of FIG. 4 is shown as FIG. 5. FIG. 5 is recognized as a top plan view of strip 25 from which it is apparent that the deformation is limited by web 26. Further enlargement of the web area defined as segment 6 of FIG. 5 is shown as FIG. 6 where a small wedge 28 is seen to be cut into the center of web 26 to promote bending at the desired point. Wedge 28 also facilitates the cutting operation to be performed by the automatic device yet to be described.

The adaptability of clip 10 as fabricated in the form of strip 25 and coiled into a roll 27 is illustrated in FIG. 8, FIG. 8 showing an automated assembly station 29 in which the clips 10 are attached to wooden frame members 17 by a suitable driver 32. Driver 32 and a circular cartridge 33 which holds the coiled strip 25 are mounted on a frame 34 resembling a horizontal ladder supported by vertical legs 35. The wooden frame members 17 are carried along one edge of frame 34 by a conveyor means 36 and are prevented from falling over the edge by a rail 37, shown as an example, running along the edge of frame 34 just outboard of conveyor means 36.

Driver 32 is mounted on a plate 38 spanning the two opposite side rails of frame 34 with hammerhead 39 of the driver directed toward the inboard edge of the passing frame member 17.

Cartridge 33 lies horizontally across frame 34 in a position such that as strip 25 of clips 10 is unreeled the clips are appropriately aligned with the edge of frame member 17 so that a blow from the hammerhead 39 will sever the end clip 10 from the strip and drive the pointed outer leg of clip 10 into the bottom of the inboard edge of frame member 17. As clip 10 moves into position directly in front of driver 32, end 11 of clip 10 rides over the top surface of frame member 17. Strip 25 is guided to this position by a fixed rail obscured from view in FIG. 8 and running parallel to frame member 17 along its inboard edge, the rail assuring clearance between the pointed end 14 of clip 10 and frame member 17.

Driver 32, as illustrated in FIG. 8, and in part in FIGS. 9 and 10, comprises a compressed air cylinder 41 with a compressed air delivery line 42, a fixed ram chamber 43 and hammerhead 39. Hammerhead 39 has a rectangular cross-section which mates snugly with a rectangular opening through chamber 43, the opening through chamber 43 being in direct communication with the inside of air cylinder 41 so that as air pressure inside cylinder 41 is abruptly raised hammerhead 39 is driven sharply outward as indicated by the broken line position shown in FIG. 10. As the air pressure is reduced, hammerhead 39 is returned either by spring action or by a suitable pressure applied inside of cylinder 41.

Working in cooperation with driver 32 to sever clip 10 from strip 25 and to secure it to frame member 17 is a heavy metal anvil 45 which backs up the guide rail 37 opposite driver 32 and the obscured fixed rail that guides strip 25 into position. The end of this fixed rail has a shearing edge aligned with one of the sharpened projecting edges 44 of hammerhead 39, the aligned shearing edge being positioned just behind clip 10 so that as hammerhead 39 is driven forward, its edge 44 strikes wedge 28 in web 26 which secures clip 10 to strip 25. Edge 44 in cooperation with the aligned shearing edge of the obscured guide rail severs clip 10 from strip 25 and carries it forward toward frame member 17 so that the pointed ends 14 are driven firmly into the wooden frame member 17 until clip 10 comes to rest secured in the position shown in FIG. 7. Thus, the clip is firmly attached to the frame without chance of being pulled out or worked loose.

When clip 10 has been thus secured, the frame members 17 are advanced to the left as indicated by the arrows in FIG. 8. The length of travel for each advancement of members 17 is of course equal to the spacing 46 between the attached clips 10'.

Thus, it has been shown that a relatively simple arrangement may be contrived for a completely automatic operation in which clips 10 are dispensed in the form of a coiled strip 25 from a cartridge 33 and secured to frame members 17. Expensive manual operations are thus eliminated and furniture of better quality can be made available to the consumer at reduced cost.

Where such a totally automatic system is not practical or warranted, a semi-automatic attachment means may be employed. As suggested by FIG. 11, a hand-held pneumatic gun 47 may be adapted to carry a strip 25 of clips 10 on a spring-fed carrier 48.

Gun 47 has an air cylinder 50, a pistol grip handle 51, a trigger 52, a ram chamber 53, a compressed air delivery line 54 and a concealed hammerhead. The ram chamber 53 is slotted to the contour of clip 10 so that the clip may be moved into position therein prior to the severing and driving operation.

In the use of gun 47, the forward end of ram 53 with a clip 10 appropriately positioned therein is held against the edge of wooden frame member 17. Trigger 52 is then pulled, admitting air under pressure to chamber 53 thereby driving the concealed hammerhead forward severing the end clip and driving it into frame member 17. The trigger 52 is then released, air pressure inside chamber 53 falls to atmospheric and the hammerhead is returned by spring action. As the hammerhead returns rearward, the next clip 10 is moved into position inside the slotted end of chamber 53 in preparation for the ensuing operation.

The improved clip 10 and its fabrication in strip form are thus seen to have enhanced utility both in the end use of the clip and through the assembly operation by automatic or semi-automatic means.

FIG. 15 illustrates a modification of the clip shown in FIGS. 1 and 2 wherein clip 57 is similar to clip 10 and contains the same reference characters for like parts thereof but differs primarily in the width of the clip at the spring engaging U-shaped end 11'. The reason for this modification is to adapt the clip for easy assembly with different types of springs.

FIG. 13 discloses a cross-sectional view of a liner 58 which may be formed of a plastic such as, for example, polyethylene, extruded with the cross section as shown in FIG. 13. Such an extrusion of, for example, 10,000 feet, rolled on a reel may be fed into a special arrangement in a die where it could be crimped onto a clip formed as shown in FIG. 14.

The clip 60, only a part of which is shown in FIG. 14, comprises at its spring-engaging end 61 one or more tabs or fingers such as fingers 62, 62A punched out of their end of the clip which are arranged to hold the liner 58 in place in end 61 of the clip.

The internal shape of the extrusion is rounded out at 63 to permit a round wire of an engaging or mating spring (not shown) to slide through the tapered legs 64, 64A of liner 58 and be retained therein by U-shaped end 61 of the clip 60 and to keep it in there, i.e. locked therein, so that it can not snap back out of these tapered legs when the clip is in actual use.

The use of such an extrusion is less costly, uniformly more consistent and can be assembled at a faster rate of speed than the prior art use of tape pressure fitted on the clip. Further, the wear resistance of the extruded surface of the liner inside of the U-shaped clip is superior to the wear resistance of tape and other known noise control means used on furniture clips.

It should be noted that in place of the liner being extruded and then placed in the U-shaped end of the clip, the plastic material in this U-shaped end of the clip may be molded therein, one example of which is shown in FIGS. 16 and 17, by the clip cross-sectional view of a clip configuration 63. This could involve a multi-piece mold (not shown) which would surround the clip with molten polythylene 64 forced through appropriate openings in the mold into areas of the clip wherein the extruded liner is shown in FIG. 14. This procedure could save manufacturing costs over the extruded liner of FIGS. 13 and 14.

As shown in FIG. 15, the clip may be provided with an aperture 65 through which the polyethylene 64 may be extruded to form a locking plug 66 for holding the liner in place in the clip.

FIG. 17 illustrates a further modification of the spring clip disclosed in FIGS. 1, 2, 12 and 13 wherein a spring clip 67 is shown comprising a clip configuration similar to that shown in FIGS. 1 and 2. Like reference characters are used for like parts; however, the structure differs in end 11'' having its leg 68 being curved back on itself and again bent back on itself at 69 to form a further extension 70 of leg 68 for a given distance. A further U-shaped configuration 71 is formed with a continuing leg 72 thereof extending to a point where leg 72 terminates in a U-shaped channel configuration 73, the outer edge 74 of which lies above surface 19 in substantially the same plane therewith.

This structure is intended to have its legs 14 clamped onto a furniture rail member in the same way as heretofore described with the remaining ribbon-like spring configuration positioned thereabove. When a number of these spring clips are spacedly mounted along a rail the opposite channel-like ends 73 are loosely interconnected by a wire or cord extending longitudinally of the rail member to which the legs 14 are attached and along the length of each channel configuration 73.

Thus, if a chair or couch cushion support was formed by internal structure comprising a plurality of clips 65 extending along a rail, the upper leg 70 of clip 65 and the cord extending along channel configuration 71 thereof the clips could form a soft top and front edge of the box cushion support in a manner understandable by people skilled in the art.

Although but a few embodiments of the invention have been illustrated and described, it will be apparent to those skilled in the art that various changes and modifications may be made therein without departing from the spirit of the invention or from the scope of the appended claims.

What is claimed is:

1. A clip for securing to a furniture frame member or support one end of a spring comprising:

a first portion to be disposed across the edge of a frame member in engagement therewith, a second portion at substantially right angles to said first portion adapted for engaging the outer face of the frame member;

the free end of said second portion extending inwardly under said first portion and formed to provide at least one pointed leg member to be driven into the frame member for receiving the clip thereon, the free end of said first portion being reversely bent to extend thereover to form a narrow slot having an opening outwardly of the frame member when secured to the frame member for receiving one end of a spring, whereby spring tension when applied to the clip will be in the direction in which said leg is driven into the frame member, the edges of the reversely bent part of the free end of said first portion being bevelled outwardly to each provide a ridge to protect the end of the spring lying in said slot from abrasive wear to reduce noise of its movement over said edges and to strengthen said reversely bent part, and a liner covering at least a part of the inside surface of said slot serving as an interface between the clip and the spring.

2. The clip set forth in claim 1 wherein:

said liner comprises a plastic means.

3. The clip set forth in claim 1 wherein:

said liner comprises an extruded plastic member secured within said slot.

4. The clip set forth in claim 3 wherein:

said plastic member has a substantially U-shaped cross-sectional configuration.

5. The clip set forth in claim 4 wherein:

the inner closed end of the U-shaped configuration of said plastic member is provided with an arcuate shape covering substantially its complete inside surface.

6. The clip set forth in claim 4 wherein:

said arcuate shape is of a circular configuration.

7. The clip set forth in claim 6 wherein:

said plastic member is formed of polyethylene.

8. The clip set forth in claim 6 wherein:

said first member is provided with at least one tab pushed out of its surface for overlapping the end of said plastic means to hold the plastic means firmly in place in the slot of said first member.

9. A strip of interconnected clips each used for securing one end of a spring to a furniture frame member comprising:

a plurality of interconnected clips, each of said clips comprising a first portion to be disposed across the edge of a frame member in engagement therewith, a second portion at substantially right angles to said first portion adapted for engaging the outer face of the frame member, the free end of said second portion extending inwardly under said first portion and formed to provide a pointed leg member to be driven into the frame member for securing the clip thereon, the free end of said first portion being reversely bent to extend thereover to form a narrow slot having an opening outwardly of the frame member when secured to the frame member for receiving one end of a spring, and tab means forming a part of said second portion of said clips interconnecting surfaces of the second portion of similarly aligned juxtapositioned clips in a strip configuration, whereby said strip may be maintained and used in a straight strip, curved or coil configuration.

10. The strip of interconnected clips set forth in claim 9 wherein:

said tab means comprises a pair of spaced tabs one on each side of said second portion.

11. The strip of interconnected clips set forth in claim 9 wherein:

said tabs are coplanar with the outer surface of said second portion of each of said clips.

12. The strip of interconnected clips set forth in claim 9 wherein:

said tabs are substantially of the same thickness as said second portion of each clip.

13. The strip of interconnected clips set forth in claim 9 wherein:

at least one of said tab means between each clip is provided with a wedge-shaped opening for receiving a power-driven shearing means.

14. The strip of interconnected clips set forth in claim 9 wherein:

the edges of the reversely bent part of the free end of the first portion of each clip is bevelled outwardly to each provide a ridge to protect the end of the spring lying in the slot of that clip from abrasive wear, to reduce noise of its movement over said edges of each clip and to strengthen said reversely bent part.

15. The strip of interconnected clips set forth in claim 14 wherein:

each of said clips is provided with a liner covering substantially the complete surface of the inside periphery of its slot which serves as an interface between the clip and the spring.

16. The strip of interconnected clips set forth in claim 15 wherein:

each of said liners is formed of a plastic material extruded into a U-shaped configuration firmly held in place in said slot.

17. The strip of interconnected clips set forth in claim 16 wherein:

the second portion of each of said clips is provided with an indexing aperture for registration purposes.

18. A clip for securing to a furniture frame member for supporting one end of a spring comprising:

a first portion to be disposed across the edge of a frame member in engagement therewith, a second portion at substantially right angles to said first portion adapted for engaging the outer face of the frame member, the free end of said second portion extending inwardly under said first portion and formed to provide at least one pointed leg member to be driven into the frame member for receiving the clip thereon, the free end of said first portion being reversely bent at a point along its length to extend thereover to form a narrow slot having an opening outwardly of the frame member when secured to the frame member for receiving one end of a spring, whereby spring tension when applied to the clip will be in the direction in which said leg is driven into the frame member, said free end of said first portion extending from said slot toward said second portion and then bent back on itself and extending a predetermined distance where it is reversely bent back on itself again and extending to said second portion and forming a U-shaped channel at its end opening in a direction of said second portion for receiving an aligning member when a plurality of said clips are spacedly arranged along the frame member in substantially parallel alignment.

19. The clip set forth in claim 18 wherein:

said first and second portions are of a relatively thin ribbon configuration.

20. The clip set forth in claim 19 in further combination with:

a liner covering the surface of said slot serving as an interface between the clip and the spring, said liner comprising a plastic U-shaped configuration.

21. The clip set forth in claim 18 wherein:

said free end of said first portion is provided with a reverse bend at a point along its length between said slot and said U-shaped channel.

* * * * *

UNITED STATES PATENT OFFICE

CERTIFICATE OF CORRECTION

Patent No. 4,153,959 Dated May 15, 1979

Inventor(s) Herbert Omley

It is certified that error appears in the above-identified patent and that said Letters Patent are hereby corrected as shown below:

Page 1, after "Background of the Invention" cancel "This application is a continuation of Serial No. 705,135 filed 07/14/1976 now abandoned."

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*